United States Patent [19]

Lee

[11] Patent Number: 4,783,286

[45] Date of Patent: Nov. 8, 1988

[54] ROTOR-ACTUATING CARBURETOR WITH VARIABLE VENTURI TUBE

[76] Inventor: Tien-Chu Lee, P.O. Box 10160, Taipei, Taiwan

[21] Appl. No.: 137,363

[22] Filed: Dec. 23, 1987

[51] Int. Cl.[4] ..... F02M 9/08

[52] U.S. Cl. ..... 261/23.2; 261/62; 261/44.8; 261/121.3; 261/DIG. 56; 261/41.5

[58] Field of Search ..... 261/62, 41.5, DIG. 56, 261/121.3, 44.8, 23.2

[56] References Cited

U.S. PATENT DOCUMENTS

| | | | |
|---|---|---|---|
| 1,172,388 | 1/1916 | Prescott | 261/62 |
| 1,265,588 | 5/1918 | Baverey | 261/44.8 |
| 1,547,296 | 7/1925 | Bullard | 261/62 |
| 2,732,193 | 1/1956 | Wentz, Jr. | 261/DIG. 56 |
| 2,750,168 | 6/1956 | Winkler | 261/121.3 |
| 3,575,390 | 4/1971 | Bickhaus | 261/62 |
| 3,682,449 | 8/1972 | Severn | 261/62 |
| 3,796,415 | 3/1974 | Dreher | 261/41.5 |
| 4,034,028 | 7/1977 | Ma | 261/DIG. 56 |
| 4,539,163 | 9/1985 | Sakurai | 261/41.5 |

*Primary Examiner*—Tim Miles

[57] ABSTRACT

A carburetor includes a throttling rotor formed as a semi-circular cylinder rotatively mounted in an induction casing to operatively define a variable throat section of a venturi tube between the rotor and fuel nozzles mounted on one side of the casing opposite to the semi-circular cylinder, corresponding to an engine running speed, so as to enforce a sound mixing of a fuel as sucked by an air stream when passing through the throat section for increasing the efficiency of fuel combustion and engine running.

8 Claims, 4 Drawing Sheets

ROTOR-ACTUATING CARBURETOR WITH VARIABLE VENTURI TUBE

BACKGROUND OF THE INVENTION

A conventional fixed venturi tube carburetor as shown in FIG. 8 includes an induction pipe I having a throat section V of a venturi tube for sucking fuel from a float chamber F through a choke tube C by an air stream A enterring the pipe I, wherein the fuel will not be completely atomized under slow running of an engine because the air flowing velocity is so slow as passing through such a fixed venturi tube of which the throat area can not be variably reduced corresponding to the engine slow running, thereby reducing the engine combustion efficiency, wasting energy and possibly causing air pollution due to incomplete combustion of fuel. Even at an idling situation, a throttle valve T can be closed to leave merely a narrow gap between the valve T and the carburetor wall to develop a suction effect as shown at A1 of FIG. 8 to suck fuel through a pilot system PS, which however still dissipates into two air streams A1 and A2 to thereby reduce the air velocity and reduce the suction force for the pilot system, resulting in a poor atomization of the fuel droplets and a lower engine efficiency accordingly.

A conventional variable choke carburetor is shown in FIG. 9 may even variate its choke area by reciprocatively moving a jet needle J within a nozzle N as actuated by a piston P in a suction chamber S for a better mixing of air A with a fuel from float chamber F. However, when the jet needle J is subject to a slow or idling engine running having small gap between the needle and a nozzle orifice, the needle J will be easily worn to influence its fuel suction capacity due to a frictional scrubbing between the needle and the nozzle orifice under frequent vibrations caused by the reciprocative movements of the piston P.

The present inventor has found the drawbacks of conventional carburetors and invented the present rotor-actuating carburetor having a variable venturi tube.

SUMMARY OF THE INVENTION

The object of the present invention is to provide a carburetor having a thorttling rotor formed as a semi-circular cylinder rotatively mounted in an induction casing and operatively defining a variable throat section between the rotor and plural fuel nozzles mounted on the casing opposite to the rotor corresponding to an engine running speed, so as to enforce a better atomization of a fuel for increasing fuel combustion efficiency and saving energy.

DETAILED DESCRIPTION

Figure 1:
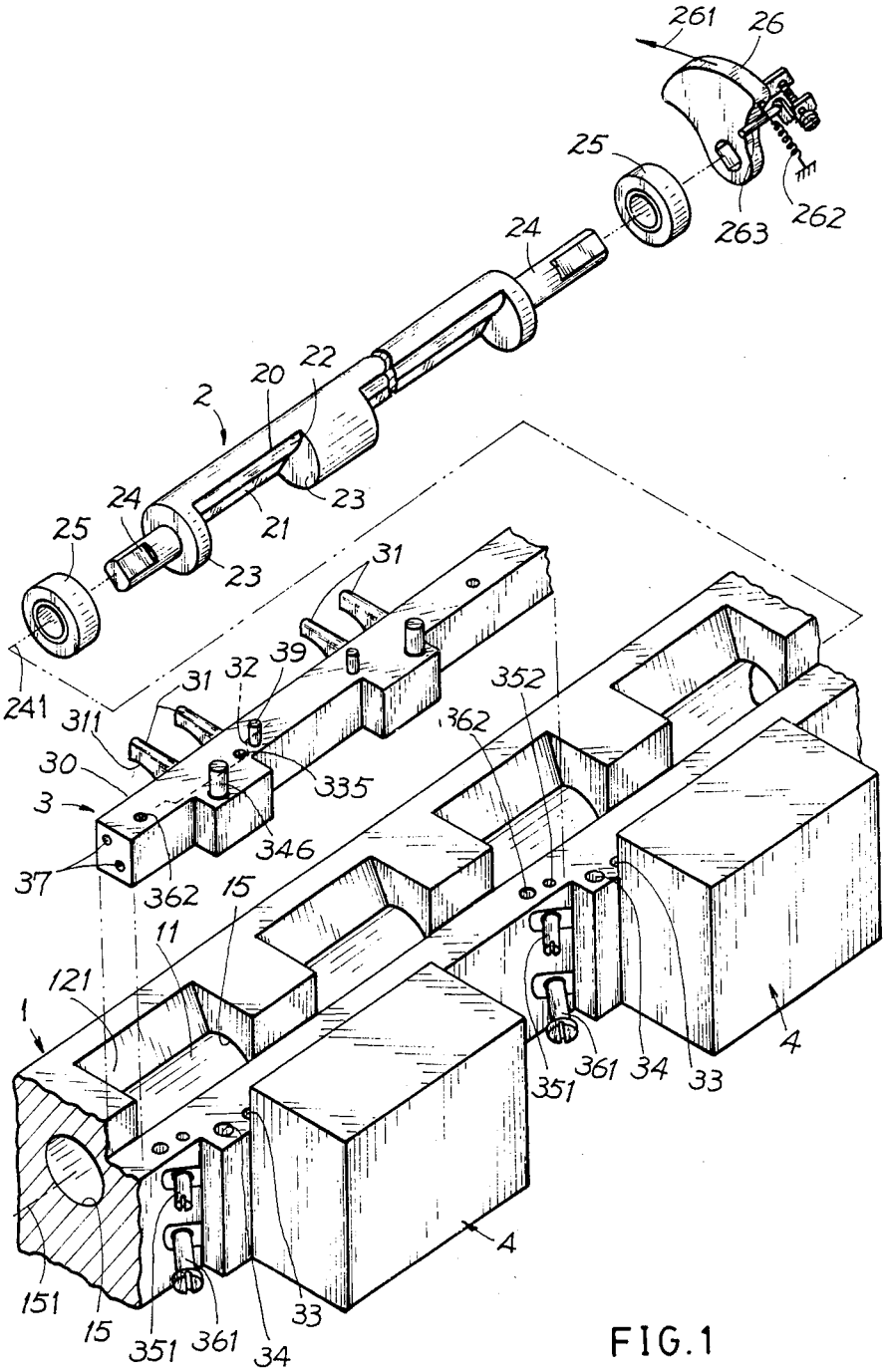
FIG. 1 is a disassembled illustration showing a variable carburetor of four rotors for 4-cylinder engine in accordance with the present invention.

As shown in FIGS. 1–7, the present invention comprises: an induction casing 1, a throttle rotor 2, a fuel injecting means 3 and a float chamber 4 mounted on right side of the casing 1.

The induction casing 1 includes: a cylindrical rotor chamber 11 longitudinally formed on a central portion of the casing 1, an air inlet duct 12 formed on an upper portion of the casing 1 having a choke 122 rotatably formed in the duct 12 and having a contraction portion 121 formed on a lower portion of the duct 12 to communicate with the cylindrical rotor chamber 11, an air outlet duct 13 formed on a lower portion of casing 1 having an expansion portion 131 formed on an upper portion of the duct 13 to communicate with the chamber 11 and communicated with an engine cylinder, a guiding baffle 14 secured to a left portion of the expansion portion 131 of the duct 13, and a pair of rotor holes 15 respectively formed in the casing 1 at two opposite ends of the rotor chamber 11. A shield **14*a* is provided between the duct 12 and the rotor 2** for a dust-proof purpose.

The throttling rotor 2 includies: a semi-circular cylinder portion 21 longitudinally formed on a central portion of the rotor 2 having an arcuate convex portion 22 formed between a right secant edge 20 of the rotor 2 and a longitudinal axis 241 of the rotor 2, a pair of side wheels 23 formed on two opposite ends of the semi-conductor cylinder portion 21 rotatably mounted in the two rotor holes 15 of the casing 1, a driving shaft 24 formed on two ends of the rotor 2, a pair of bearings 25 rotatably mounting the rotor 2 on the casing 1, and a driving wheel 26 mounted on one end of shaft 24 operatively driven by a wire 261 connected to an accelerator pedal (not shown) and normally restored by a tensioning spring 262 secured to the casing 1. A longitudinal axis 241 of shaft 24 coincides with an axis 151 of the rotor holes 15 of the casing 1.

Figure 4:
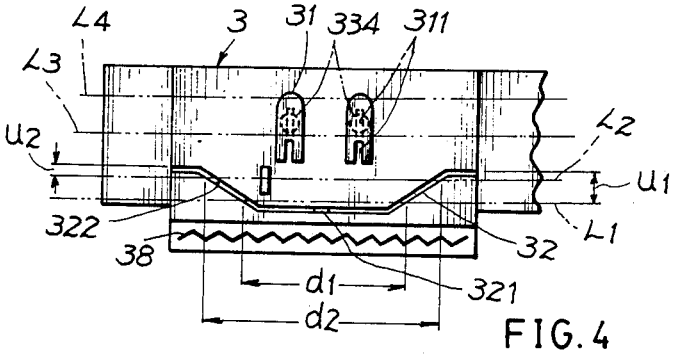
FIG. 4 is an illustration showing plural nozzles of the fuel injecting means of the present invention when viewed from direction II of FIG. 2.

The fuel injecting means 3 mounted on a right portion **1*a* of the casing 1 includes: an air-drafting surface 30 formed as a generally vertical plane and oppositely facing the semi-circular cylinder portion 21 of the rotor 2, at least a primary nozzle 31 protruding leftwardly from the air-drafting surface 30 having an arcuate slit 311 formed on an opening of the nozzle 31 circumferentially disposed above and adjacent to an upper periphery of the semi-circular cylinder portion 21, a secondary nozzle 32 having a V-shaped slit longitudinally formed on surface 30 of injecting means 3 having a lower slit portion 321 operatively forming a minimum venturi aperture between a right secant edge 20 of the cylinder portion 21 when the rotor edge 20 rotating rightwardly toward its uppermost right position and having upper slit portions 322 divergently extending upwardly from the lower slit portion 321 as shown in FIG. 4, a primary mixer 33 fluidically communicated with the primary nozzle 31 and the float chamber 4, a secondary mixer 34 fluidically communicated with the secondary nozzle 32 and the float chamber 4**, a micro-adjuster for gas mixture 35, a micro-adjuster for air 36, a passage 37 for circulating oil or water for preheating the fuel injecting means 3 and an electric heater 38 inserted in the means 3 also for preheating the injecting means 3.

Figure 2:
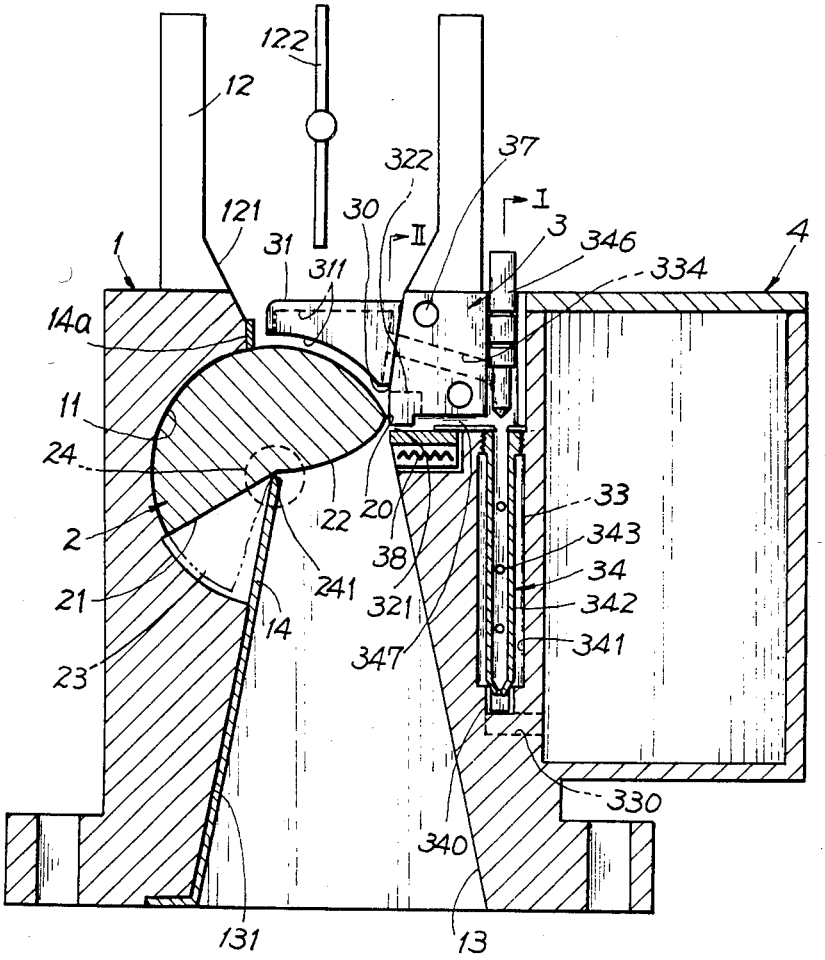
FIG. 2 is a side-view sectional drawing of the present invention.
Figure 7:
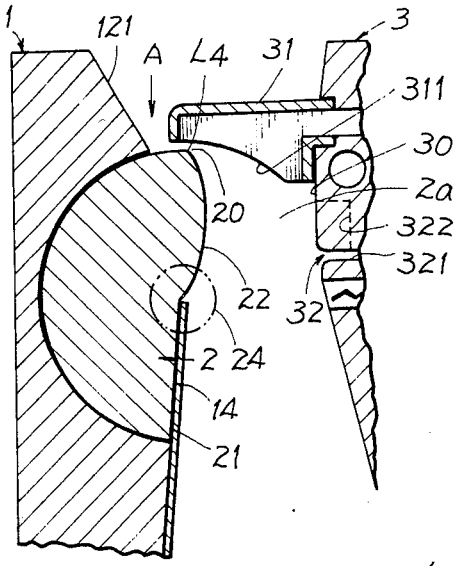
FIG. 7 shows a rotor of the present invention at high speed.

The primary nozzle 31 is positioned above the secondary nozzle 32 and can be made plural such as two primary nozzles 31 as shown in the figures. The semi-circular cylinder portion 21 of rotor 2 operatively defines a throat section 2*a* of a venturi tube of the carburetor of the present invention between the cylinder portion 21 and the nozzles 31, 32. The cylinder portion 21 has its right secant edge 20 operatively defining a minimum throat section with the secondary nozzle 32 when the rotor 2 is rightwardly rotated to its uttermost right position as shown in FIG. 2 as limited by a right limiting rod 263 as shown in FIG. 1. The cylinder portion 21 has its arcuate convex portion 22 operatively defining a maximum throat section with the primary nozzles 31 and secondary nozzle 32 as shown in FIG. 7 when the rotor 2 is leftwardly rotated to its uttermost left position as limited by the guiding baffle 14 protruding upwardly to be adjacent to a longitudinal axis 241 of the rotor 2.

The primary mixer 33 includes: an outer tube 331 having a lower conduit 330 formed on a bottom portion of tube 331 communicated with the float chamber 4 filled with fuel oil, an inner tube 332 inserted in tube 331 having plural perforations 333 formed through the inner tube, an upper conduit 334 formed on a top portion of the tube 332 communicated with the arcuate slit 311 of the primary nozzle 31, and a main air tube 335 having an orifice 336 formed between the outer tube 331 and an air port 335*a* communicated with an inlet air source.

The secondary mixer 34 includes: an outer tube 341 having a lower conduit 340 formed on a bottom portion of tube 341 communicated with the outer tube 331 of the primary mixer 33, an inner tube 342 inserted in tube 341 having plural perforations 343 formed through the inner tube 341, an idling-control needle valve 346 formed on a top portion of the mixer 34 operatively opening or closing an orifice 346*a* formed on an upper portion of the inner tube 341, an idling air tube 344 having an orifice 345 formed thereon communicated with an upper portion of an inner tube 331 of the primary mixer 33 and the outer tube 341 fluidically communicated with primary nozzle 31 for leading air through nozzle 31, and an outlet tube 347 formed on an upper portion of the inner tube 341 communicated with the secondary nozzle 32. The needle valve 346 is controlled by a solenoid and a linking means as wellknown in the art.

The micro-adjuster for gas mixture 35 includes a needle valve 351 mounted on the casing 1 having a gas tube 352 communicated with the outlet tube 347 and the outlet duct 13 for further adjusting the gas mixture flowing into the downstream of the outlet duct 13. The micro-adjuster for air 36 includes a needle valve 361 mounted on the casing 1 having an air tube 362 communicated with an inlet air source and the outlet duct 13 for further adjusting an air flow passing into the outlet duct 13. Both micro-adjusters 35, 36 are auxiliary devices adapted for compensating the adjustment operation of the fuel injecting means 3 of the present invention. Other conventional devices such as an enrichment needle 39 are wellknown in the art and their description if therefore omitted.

The present invention can be connected in series forming plural carburetors having plural rotors adapted for corresponding plural engine cylinders. For instance, four rotors 2 as respectively mounted in four chambers as shown in FIG. 1 can be modified by those skill in the art. The number of rotors is therefore not limited in this invention.

Figure 5:
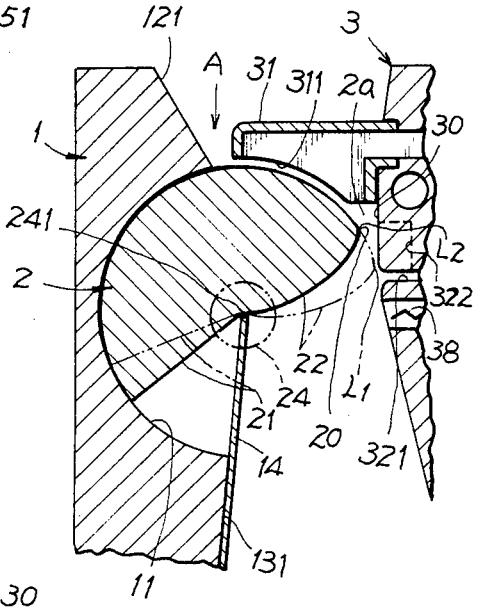
FIG. 5 is an illustration showing a rotor position of the present invention at slow speed.

In using the present invention, when the engine is running at idling situation as shown in FIG. 2 and as shown in dotted line of FIG. 5 the right secant edge 20 forms a minimum throat area with the secondary nozzle 32 (the arcuate convex portion 22 being generally horizontal). The right edge 20 can be hypothetically assumed as L1 as projectively shown in FIG. 4 slightly positioned above the lower slit portion 321 of the secondary nozzle 32. At idling situation, the engine is slowly running under no load to draft very small quantity of inlet air. Since a suction force (negative pressure) is only developed in the throat section (d1) under L1 as shown in FIG. 4, the upper slit portions 322 and the primary nozzle 31 above L1(U1) will get positive pressure without sucking fuel through the nozzle 31 and the upper slits 322 and the lower slit 321 can only suck small amount of fuel by the air stream flowing through such a minimum throat to enforce the sound mixing of gas with air at idling situation. Reviewing FIG. 3, the fuel is drafted from the lower conduits 330, 340 and pre-mixed with small air stream as flowing through idling air tube 344 of the secondary mixer 34 and finally sprayed through outlet tube 347 and slit 321 of secondary nozzle 32.

As shown in FIG. 5, the right secant edge 20 and the convex portion 22 of the rotor 2 form a throat larger than the throat area as shown in FIG. 2. The right edge 20 of the rotor is now assumed as L2 as shown in FIG. 4 to reveal a bigger suction area of the secondary nozzle 32 including the lower slit 321 and partial upper slits 322 (d2) below L2 (the upper slit U2 above L2 is smaller than U1 as aformentioned), to thereby exert a bigger suction force (due to Bernoulli's equation) than that at idling situation as aforesaid and therefore be suitable for slow engine running.

Figure 6:
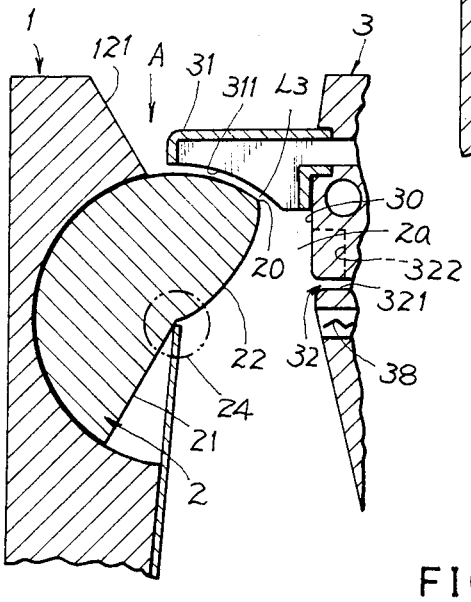
FIG. 6 is an illustration of the present invention at middle speed.

In FIG. 6, the position L3 of the rotor reveals a wider throat than that as shown in FIG. 5 to allow large air flow and to exert bigger suction force since L3 is positioned above the secondary nozzle 32 and above partial artcuate slit 311 of the primary nozzle 31, thereby resulting in larger suction of fuel for middle-speed of an engine running.

In FIG. 7, a high-speed engine running is illustrated since the semi-circular cylinder portion 21 of rotor 2 is leftwardly rotated to its uttermost left position to form a maximum throat area between the convex portion 22 of rotor 2 (generally vertical) and the nozzles 31, 32 to allow maximum air flow and biggest suction of fuel for the need of a high-speed running.

In modifying the present invention, the secondary nozzle 32 can be made as a real V shape other than the truncated lower slit 321 as shown in FIG. 4 and the convex portion 22 of the rotor 2 can also be made flat to reveal a real semi-circular cylinder 21 other than the convex portion 22 as shown in the figures.

The present invention has the following advantages superior to a conventional carburetor:

1. The throat of a carburetor venturi tube can be optionally adjusted such as by an accelerator pedal to meet any engine running conditions for enforcing a sound mixing of fuel with air, for increasing an engine efficiency and for saving energy.

2. A conventional throttle valve used in a carburetor is omitted.

Figure 3:
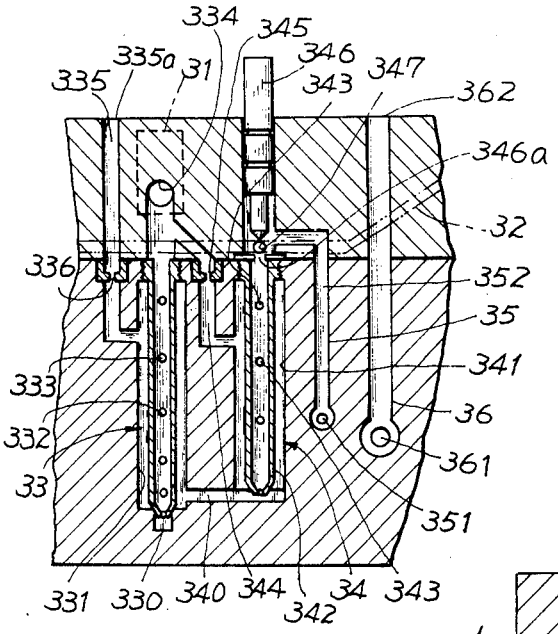
FIG. 3 is an illustration showing a fuel injecting means of the present invention as viewed from direction I of FIG. 2.

3. At idling stage, the secondary mixer 34 is effected to draft fuel through lower conduit 340 and to lead air through orifice 345 as shown in FIG. 3. However, when the engine is running at higher speed the primary nozzle 31 is operated to suck fuel and air through the primary mixer 33 and the secondary nozzle 32 is simultaneously operated to suck fuel through the secondary mixer 34 so as to allow the fuel oil to alternatively flush the orifice 345 to prevent the clogging by dust as laden in an air stream to ensure a smooth operation of the fuel injecting system of this invention.

Figure 8:
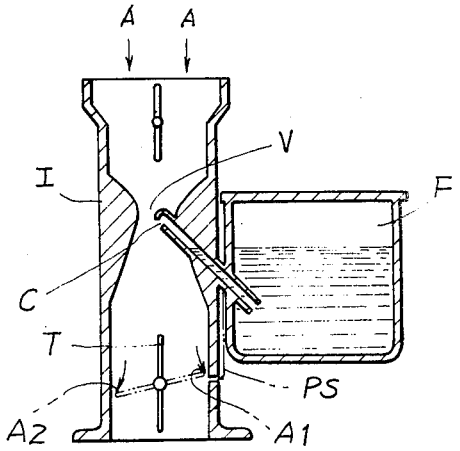
FIG. 8 PRIOR ART
FIG. 8 shows a conventional fixed venturi tube carburetor.
Figure 9:
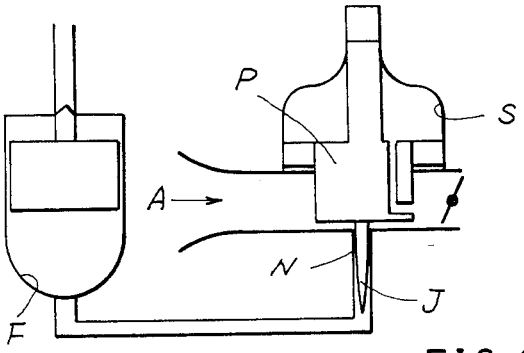
FIG. 9 PRIOR ART
FIG. 9 shows a conventional variable choke carburetor.

4. The throttling rotor 2 is stably rotatably mounted in the casing 1, to overcome the frequent vibration of a jet needle of a conventional variable carburetor (FIG. 9); and is designed to allow the air flowing through a throat operatively defined by the rotor cylinder 21 and the nozzles 31, 32 to prevent the dissipated air streams and poor venturi suction as found in a conventional throttle-valve-operated carburetor (FIG. 8).

I claim:

1. A carburetor with variable venturi tube comprising:

an induction casing including a cylindrical rotor chamber longitudinally formed on a central portion of said casing, an air inlet formed on an upper portion of said casing having a contraction portion formed on an lower portion of said inlet duct communicated with said cylindrical rotor chamber, an air outlet duct formed on a lower portion of said casing having an expansion portion formed on an upper portion of said outlet duct communicated with an engine cylinder, and a pair of rotor holes formed at two opposite ends of said rotor chamber of said casing;

a throttling rotor including a semi-circular cylinder portion longitudinally formed on a central portion of said rotor, a pair of side wheels formed on two opposite ends of said semi-circular cylinder portion rotatably mounted in said pair of rotor holes of said casing, and a driving shaft formed on two ends of said rotor operatively driven by a wire connected to an accelerator pedal;

a fuel injecting means mounted on a right portion of said casing having an air-drafting surface formed as a generally vertical plane and facing oppositely to said semi-circular cylinder portion of said rotor, a primary nozzle protruding leftwardly from the air-drafting surface to circumferentially dispose above said semi-circular cylinder portion, a secondary nozzle having a V-shaped slit longitudinally formed on the air-drafting surface of said fuel injecting means, a primary mixer fluidically communicated between the primary nozzle and a flat chamber mounted on a right side of said casing, a secondary mixer fluidically communicated with the secndary nozzle and the float chamber, said semi-circular cylinder portion of said rotor operatively defining a throat section of a carburetor venturi tube with said primary nozzle and said secondary nozzle when rotated along a longitudinal axis of said rotor; and said float chamber filled with fuel oil secured on a right side of said casing, whereby upon a draft of an air stream flowing through said inlet duct, the throat section defined between said rotor and said nozzles to said outlet duct, a suction force is developed at the throat section to adjustably suck fuel oil from said float chamber through said secondary nozzle on through both said primary and secondary nozzles, depending upon an engine running speed.

2. A carburetor according to claim 1, wherein said primary nozzle of said fuel injecting means includes an arcuate slit formed on an opening of said primary nozzle circumferentially disposed above and adjacent to an upper periphery of said semicircular cylinder portion of said rotor.

3. A carburetor according to claim 1, wherein said secondary nozzle formed under said primary nozzle includes a lower slit portion and two upper slit portions divergently extending upwardly from said lower slit portion, said lower slit portion operatively defining a minimum throat section with a right secant edge formed on a right end portion of said semi-circular cylinder portion when rotated rightwardly to an uttermost right position of siad rotor cylinder portion.

4. A carburetor according to claim 1, wherein a guiding baffle is secured to a left portion of said expansion portion of said air outlet duct and operatively limiting said semi-circular cylinder portion when rotated leftwardly to an uttermost left position of said cylinder portion.

5. A carburetor according to claim 1, wherein said primary mixer of said fuel injecting means includes an outer tube having a lower conduit formed on a bottom portion of said outer tube communicated with said float chamber, an inner tube inserted in said outer tube having plural perforations formed therethrough, an upper conduit formed on a top portion of said inner tube communicated with said arcuate slit of said primary nozzle, and a main air tube connected between said outer tube and an inlet air source.

6. A carburetor according to claim 1, wherein said secondary mixer of said fuel injecting means includes an outer tube having a lower conduit communicated with the outer tube of said primary mixer, and an inner tube inserted in said outer tube of said secondary mixer having perforations formed through said inner tube, an idling-control needle valve formed on an upper portion of said inner tube of said secondary mixer, an idling air tube having an orifice connected between said inner tube of said primary mixer and said outer tube of said secondary mixer, and an outlet tube operatively controlled by said idling-control needle valve connected between said inner tube of said secondary mixer and said secondary nozzle.

7. A carburetor according to claim 1, wherein said semi-circular cylinder portion of said rotor includes an arcuate convex portion formed between a right secant edge of said cylinder portion and a longitudinal axis of said rotor, said arcuate convex portion and said right secant edge of said rotor operatively defining a maximum throat section between said rotor and said fuel injecting means when rotated leftwardly to an uttermost left position of said rotor.

8. A multiple-rotor carburetor assembly comprising a connection of plural carburetors and plural said rotors in series with each carburetor having the limitations as set forth in claim 1.

* * * * *